United States Patent [19]

Stalson et al.

[11] Patent Number: 4,461,654

[45] Date of Patent: Jul. 24, 1984

[54] METHOD FOR REMOVING SCALE DUST FROM STEEL ROD AFTER MECHANICAL DESCALING

[75] Inventors: Stanley L. Stalson, Richfield; William H. Johns, Stow, both of Ohio

[73] Assignee: Wire Lab Company, Richfield, Ohio

[21] Appl. No.: 471,281

[22] Filed: Mar. 2, 1983

Related U.S. Application Data

[60] Division of Ser. No. 356,482, Mar. 9, 1982, Pat. No. 4,394,786, which is a continuation-in-part of Ser. No. 152,354, May 22, 1980, abandoned.

[51] Int. Cl.[3] ..... B08B 5/02

[52] U.S. Cl. ..... 134/10; 134/15; 134/32; 134/37

[58] Field of Search ..... 134/15, 21, 10, 32, 134/37; 15/306 A, 347; 72/39, 40

[56] References Cited

U.S. PATENT DOCUMENTS

| | | | |
|---|---|---|---|
| 3,044,098 | 7/1962 | Stalson | 15/302 |
| 3,496,086 | 2/1970 | Stalson et al. | 204/208 |
| 3,595,045 | 7/1971 | Fuqua | 72/39 |
| 3,736,618 | 6/1973 | Ramsey | 15/306 A |
| 3,775,806 | 12/1973 | Olbrant et al. | 15/306 A |
| 3,806,366 | 4/1974 | Cofer | 134/15 |
| 4,033,785 | 7/1977 | Gibbs | 134/15 |
| 4,296,556 | 10/1981 | Bray | 15/306 R |

OTHER PUBLICATIONS

Stalson, "An Overview of Mechanical Descaling", *Wire Assoc. Conf. Proceedings*, May 1977, pp. 63–90.

*Steel Wire Handbook*, vol. I, 1965, pp. 93–229.

*Primary Examiner*—Marc L. Caroff

*Attorney, Agent, or Firm*—Fay & Sharpe

[57] ABSTRACT

Iron oxide scale particles are removed from the surface of a mechanically descaled steel strand using jets of compressed air. The strand is moved along a central axis of a housing in continuous fashion through an upstream entrance opening, an entrance nozzle region, a central chamber region, an exit nozzle region and a downstream exit opening. Compressed air jets are directed into both the entrance and exit nozzle regions toward the central chamber region creating a venturi effect which draws air through the entrance and exit openings; thereby preventing dislodged scale particles from escaping into the atmosphere.

6 Claims, 2 Drawing Figures

METHOD FOR REMOVING SCALE DUST FROM STEEL ROD AFTER MECHANICAL DESCALING

This application is a divisional of application Ser. No. 356,482, filed Mar. 9, 1982, now U.S. Pat. No. 4,394,786, which in turn is a continuation-in-part of application Ser. No. 152,354, filed May 22, 1980 now abandoned.

BACKGROUND OF THE INVENTION

To produce a steel wire strand, steel billets are heated to red heat or higher and hot rolled in a rod mill. The elevated temperature of the processing causes the formation of iron oxides on the surface of the hot-rolled rod (designated herein as "strand"). These iron oxides, such as FeO, $Fe_2O_3$, and $Fe_3O_4$ are known as mill scale. Elevated temperature heat-treating of steel strand may also cause such scale to form.

Mill scale levels vary depending on the type of rod rolling mill used, the level of elevated temperature reached, and the time at elevated temperature. Traditional rod mills will produce rod with approximately one (1) percent by weight of mill scale. In a newer process for rod production, the hot-rolled rod is control-cooled thereby reducing mill scale levels to approximately 0.25 to 0.50 percent by weight. During the transit and storage of steel rod additional iron oxides form, commonly known as rust.

For the successful production of steel wire or strand from hot-rolled or heat-treated steel rod, the iron oxides on the rod must first be removed essentially in their entirety.

Iron oxide scale removal from hot-rolled or heat-treated steel rods can be accomplished using chemical or mechanical processing. Chemical processing includes such methods as acid pickling and molten salt bath immersion. Mechanical processing includes such methods as abrasive belting, shot blasting, and reverse bending. Reverse bend descaling is based on the fact that steel is ductile and mill scale is brittle. Controlled deformation of the steel rod therefore loosens and removes the brittle mill scale. One method of controlled deformation is reverse bending as by passing rod over a series of sheaves.

These scale removal methods are as described in Stalson U.S. Pat. No. 3,496,086 and Stalson U.S. Pat. No. 3,044,098 and the following publications:

Stalson, Stanley L., "An Overview of Mechanical Descaling," Joint Conference Proceedings, Ferrous Division/Pacific Coast Meeting, The Wire Association International, Inc., Guilford, Conn. 06437, May 19, 1977, pps. 63–90

STEEL WIRE HANDBOOK, Vol. 1, The Wire Association Inc., Stamford, Conn., 1965, "Cleaning and Coating in Preparation for Drawing," Chapter 3, pps. 93–229

This invention relates to the removal of iron oxide scale dust that remains on steel rods and strands after descaling by mechanical processing methods. The scale dust is attached to the steel strand as by electromagnetic or electrostatic forces. This abrasive residual iron oxide dust must be removed to maximize wire drawing die life and productivity. To clean steel rod in preparation for drawing, the rod is passed through the apparatus. The apparatus removes residual dust by breaking the forces attaching the dust to the steel strand using equal, opposing high-velocity multiple air jets situated at each end of the apparatus. The apparatus is further designed to contain and to collect the removed dust thereby preventing dispersion into the atmosphere. The apparatus also continuously processes the dust-laden air, separating the scale dust and returning only clean air to the atmosphere.

SUMMARY OF THE INVENTION

The present apparatus is a cleaner for the continuous removal and containment of residual scale dust from mechanically descaled steel strand that is to be drawn into wire. In typical use the cleaning apparatus operates in-line with the processing equipment cleaning mechanically descaled strand continuously prior to the strand entering the wire drawing equipment. The apparatus accomplishes the cleaning using compressed air only. The design of the apparatus is such as to cause the formation of high velocity air jets which perform the cleaning function. The high velocity air jets are further designed to create a strong inward air flow from each end of the apparatus into the center of the apparatus thereby sealing the strand entry and exit ports of the apparatus against scale dust escape. The design further causes the exhaust of the scale-air mixture into a suitable scale dust filter and containment device from which only clean air is returned to the atmosphere.

In this invention, compressed air flows through two identical tubular-type nozzles situated at each end of the apparatus passing first through multiple radial orifices situated in said nozzles. The radial orifices have a converging conical angular relation to the axis of the tubular-type nozzle. The direction of convergence is away from each end port and toward the center chamber of the apparatus. The air flow from a manifold and through the orifices creates high velocity air jets. The moving mechanically descaled strand enters the apparatus through an end port, passes through the axial centerline of the tubular-type nozzles and exits through an end port. The high-velocity converging conical air jet streams created by the orifices in the nozzles encircle, converge and impinge upon the surface of the moving strand thereby continuously removing the scale dust therefrom. The apparatus design also causes containment of the scale dust-laden air preventing dispersion to the atmosphere. The high velocity air jets create a Venturi effect which inducts outside air into the apparatus through the end ports. The strong inward air flow thus created prevents outward flow of the air-dust mixture from the end ports. The apparatus is further designed to collect and to separate, as by filtering, the scale dust from the dust-laden air, exhausting only clean, dust-free air to the surrounding area.

BRIEF DESCRIPTION OF THE DRAWINGS

The preferred embodiment of this invention is described in detail in this specification and illustrated in the accompanying drawings which form a part hereof, wherein.

DESCRIPTION OF THE PREFERRED EMBODIMENT

After mechanically descaled, the strands as taught in the prior art, have lost most of the hot-rolled mill scale. Mechanical descaling using reverse bending mechanically breaks the brittle scale from the strand surface by a combination of bending and stretching while the strand is being pulled over a set of sheaves by the wire drawing machine. Although the bulk quantity of scale is removed by the mechanical descaling process, scale dust particles remain on the surface of the strand attached as by electromagnetic or electrostatic forces. Removing the residual scale dust has been previously attempted or accomplished using such apparatus as brushes, abrasive material such as steel wool in a box, and washing and drying. This invention accomplishes the necessary scale dust removal using only controlled, high-velocity air jets. The new apparatus which is the subject of this invention is the air jet cleaner shown in FIG. 1. The cleaner removes and contains loose scale dust that clings to the surface of the rods after mechanical descaling.

The air jet cleaner effectively removes loose fine dust scale particles from all types of mechanically descaled steel rods. In a typical operation, strands such as rods or wire are cleaned at payoff speeds up to 850 fpm (4.3 meters/sec.). Low-to-high carbon steels may be cleaned along with most alloy grades.

Upon exiting from the air jet cleaner, the strand passes through a lubricant box and drawing die, which are of conventional design, and is pulled through the foregoing steps by a wire drawing machine.

Figure 1:
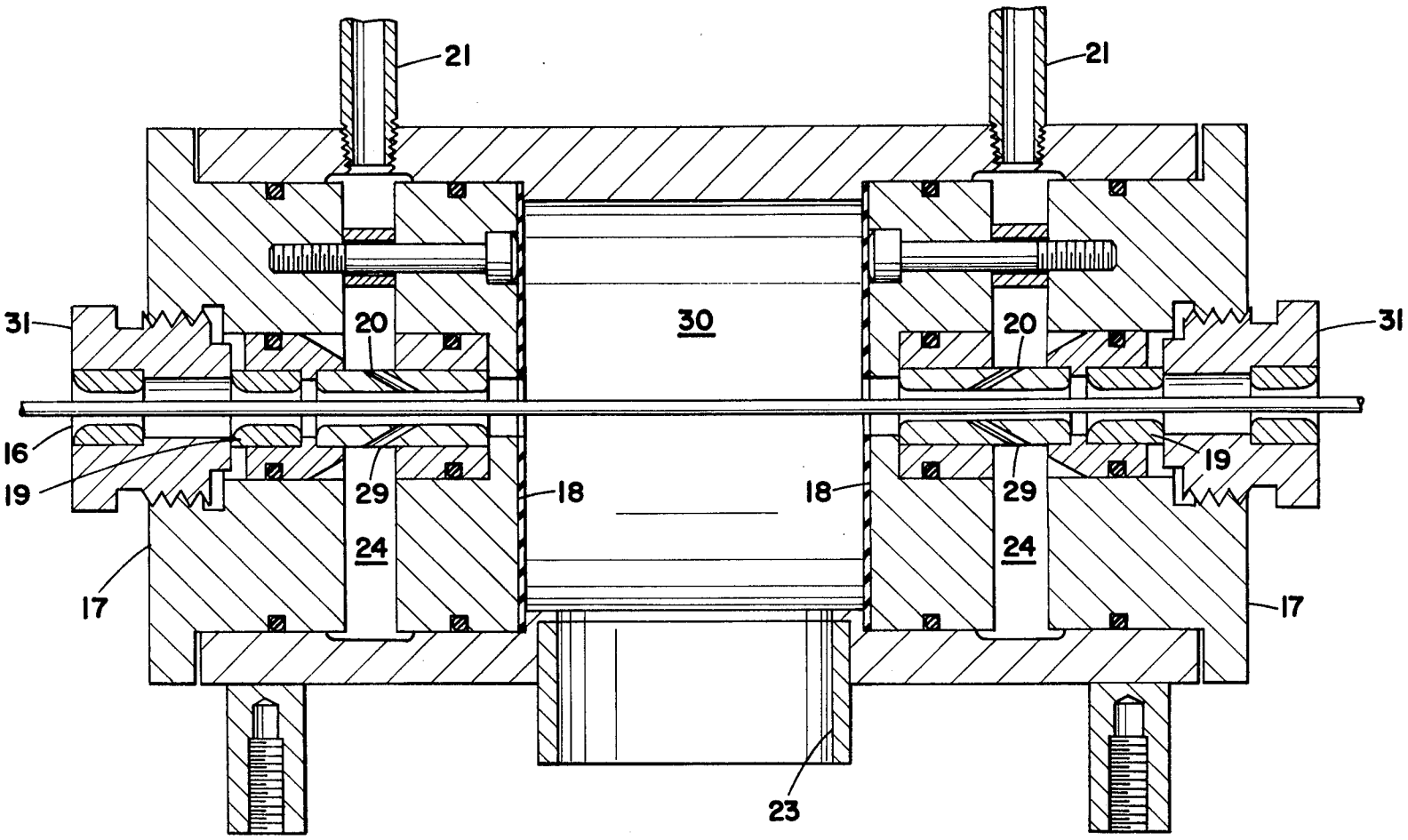
FIG. 1 is a cross-sectional view of the air jet cleaning apparatus.

FIG. 1 is a cross-sectional view of the air jet cleaner. Strands enter the cleaner at 16 and move from left to right. At the entrance and exit ends are plugs 17 and 18, shown spaced apart and forming high pressure manifolds 24. Fitted in each end and spanning the space between plugs 17 and 18 are identical tubular-type nozzles 20 held firmly in place by nozzle holders 31. At one end of each nozzle 20 are guide bushings 19. The opening in the guide bushing 19 is smaller than the central axial opening in the nozzle 20 so as to guide the strand and to keep the strand from rubbing the inside of the nozzles 20. The nozzles 20 have multiple radial air jet orifices 29. The multiple air jet orifices 29 are at an angle of 10 to 50 degrees (preferably 30 degrees) relative to the central axis of the nozzles 20 in a converging conical relationship and are directed inward with respect to each end of the apparatus and toward the central chamber 20. At the bottom of the central chamber 30 is an exhaust port 23.

In operation a common compressed air source at a pressure of 60 to 150 psi (nominally 90 psi) enters at inlets 21 and creates high pressure in the manifolds 24 formed by plugs 17 and 18. The high pressure air flows from the manifolds 24 through the multiple orifices 29 in the nozzles 20 situated at each end of the apparatus thereby creating high-velocity air jets inside the nozzles 20. The high-velocity air jets encircle, converge on and impinge the moving steel strand thereby removing the attached scale dust. The high-velocity air jets having an angular relation to the central axis of the nozzles 20 and being directed toward the center chamber 30 of the apparatus cause the dust-air mixture to flow into the center chamber 30. The high-velocity air jets further create a Venturi effect that augments the total air flow by causing the induction of outside air into the air jet cleaner at each end port 16. This further prevents the escape of dust-laden air from the end ports 16 of the apparatus. The use of identical opposing air nozzles 20 causes the now dust-laden air to flow with equal velocity and quantity into the central chamber 30 of the apparatus. Neither air stream can overcome the other thereby further assuring containment of the dust-air mixture within the apparatus. The design further causes the flow of the dust-laden air to be exhausted from the central chamber 30 only through the bottom exhaust port 23 of the apparatus and then into a suitable dust filtering and containment device, shown in FIG. 2. Only clean air is returned to the work area.

Figure 2:
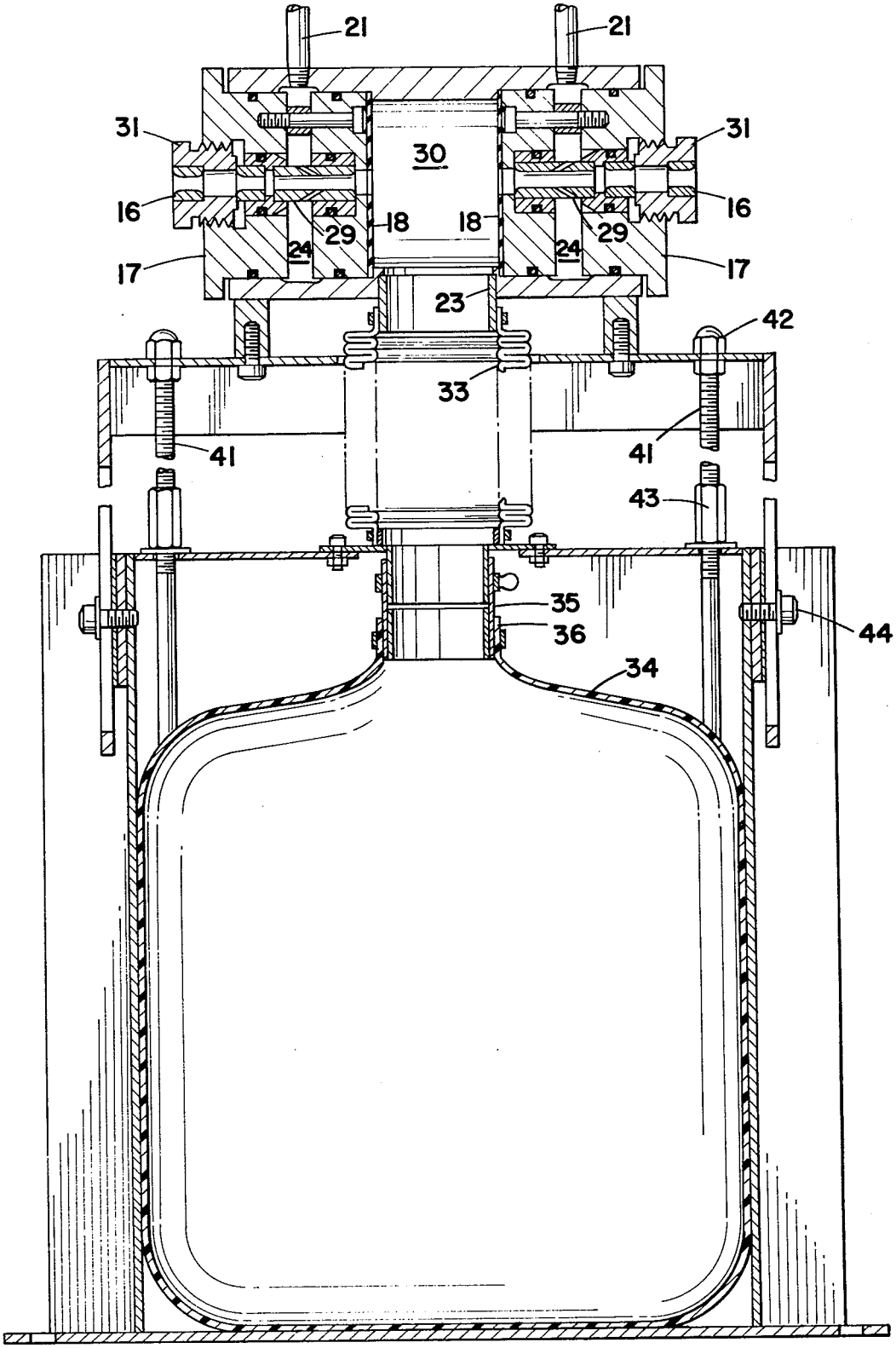
FIG. 2 is a cross-sectional view of the air jet cleaning and dust collecting containment device.

FIG. 2 is a cross-sectional view of the entire air jet cleaning and dust collecting containment device. The air jet cleaning features are highlighted in FIG. 1. FIG. 2 shows the exhaust port 23 which is secured to bellows 33 and, in turn, is connected to the dust collecting container 34. The connection is made through opening 35 in the container 34 by means of quick-release fastening clamps, such as shown at 36. Air is exhausted through openings in the fabric of container 34, which is capable of containing submicron size particles.

On top of the containment vessel are vertical adjustment screws 41 with cap screws 42 attached to the top portion and a vertical adjustment nut 43 which allow the air jet cleaner to be moved vertically to line up the cleaner with the pass line of the wire or strand in the wire drawing line.

Similar adjustments, not shown herein, provide lateral adjustment. The bellows accomodates the adjustment. Slide fastener 44 on the side permits the vertical adjustments. Quick-release clamp 36 is of the Voss type allowing secure clamping and quick release for ready replacement. The filter bags are reusable.

Although the invention has been shown and described with respect to preferred and alternative embodiments, modifications and alterations will occur to others upon a reading and understanding of this specification. The present invention includes all such modifications and alterations insofar as they come within the scope of the appended claims or the equivalents thereof.

What is claimed is:

1. A waterless method for removing particles from a wire strand, the method comprising:

moving the strand continuously through an entrance nozzle region of a housing from an upstream entrance opening in said housing, a central chamber region of said housing, and an exit nozzle region of said housing toward a downstream exit opening in said housing;

directing jets of compressed air into the entrance nozzle region toward the central chamber in such a manner that a venturi effect is created drawing air through the entrance nozzle region and mixing the air with scale particles freed from the strand, whereby the venturi effect prevents particles from escaping through the entrance nozzle region to the upstream entrance opening;

directing jets of compressed air into the exit nozzle region toward the central region in such a manner that a venturi effect is created drawing air through the exit nozzle region and mixing the air with particles freed from the strand, whereby the venturi effect prevents scale particles from escaping through the exit nozzle region to the downstream exit opening; and, collecting the scale particles carried into the central region.

2. The method as set forth in claim 1 wherein the jets of compressed air are at a pressure in the range of 60 to 150 psi.

3. The method as set forth in claim 1 wherein in the steps of directing jets of compressed air, the jets of compressed air are directed at an angle in the range of 10° to 50° with respect to a central axis of the wire strand.

4. The method as set forth in claim 3 wherein the jets of air are directed at substantially 30°.

5. The method as set forth in claim 1 wherein the step of collecting particles in the central region includes filtering the particles from the air and passing substantially particle free air to the ambient atmosphere.

6. A waterless method of removing scale particles from a carbon steel strand without disbursing scale particles into the ambient atmosphere, the method comprising:

passing the steel strand along a central axis of a housing substantially continuously from the ambient atmosphere, through an entrance opening in said housing, through a central chamber in said housing, through an exit opening in said housing, and into the ambient atmosphere;

providing a supply of compressed air under pressure;

providing a plurality of jets of the compressed air in the entrance opening, the entrance opening jets of compressed air being directed toward the central chamber in such a manner that a venturi effect is created drawing air from the ambient atmosphere, through the entrance opening, mixing the air with scale particles freed from the steel strand, and carrying the freed scale particles into the central chamber, whereby the venturi effect prevents scale particles from escaping through the entrance opening to the ambient atmosphere;

providing a plurality of jets of the compressed air in the exit opening, the exit opening jets of compressed air being directed toward the central chamber in such a manner that a venturi effect is created drawing air from the ambient atmosphere, through the exit opening, mixing the air with scale particles freed from the steel strand, and carrying the freed scale particles into the central chamber, whereby the venturi effect prevents scale particles from escaping through the exit opening to the ambient atmosphere;

separating the scale particles and air received in the central chamber; and, returning the separated air substantially free of scale particles to the ambient atmosphere.

* * * * *